US010710217B2

(12) United States Patent
Kim

(10) Patent No.: US 10,710,217 B2
(45) Date of Patent: Jul. 14, 2020

(54) WORKPIECE LOCATOR

(71) Applicants: Hyundai Motor Company, Seoul (KR); Kia Motors Corporation, Seoul (KR)

(72) Inventor: Jae Hyun Kim, Ulsan (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 357 days.

(21) Appl. No.: 15/819,268

(22) Filed: Nov. 21, 2017

(65) Prior Publication Data

US 2019/0070714 A1 Mar. 7, 2019

(30) Foreign Application Priority Data

Sep. 1, 2017 (KR) ..... 10-2017-0111942

(51) Int. Cl.
*B25B 11/00* (2006.01)
*B25B 11/02* (2006.01)

(52) U.S. Cl.
CPC ..... *B25B 11/02* (2013.01); *B25B 11/00* (2013.01)

(58) Field of Classification Search
CPC .... B25B 1/00; B25B 1/04; B25B 3/00; B25B 5/00
See application file for complete search history.

(56) References Cited

U.S. PATENT DOCUMENTS 3,924,844 A * 12/1975 Bachtel, Jr. ..... B25B 5/12 269/94
6,595,507 B2 * 7/2003 Dykstra ..... B25B 5/12 269/228
6,817,603 B2 * 11/2004 Kofod ..... B25B 5/163 269/228
7,007,938 B2 * 3/2006 Nakata ..... B23K 37/0435 269/228
8,613,433 B2 * 12/2013 Poole ..... B25B 5/04 269/228
8,827,255 B2 * 9/2014 Woods ..... B25B 5/163 269/120
2019/0070714 A1 * 3/2019 Kim ..... B25B 11/00

* cited by examiner

*Primary Examiner* — Lee D Wilson
(74) *Attorney, Agent, or Firm* — Mintz Levin Cohn Ferris Glovsky and Popeo, P.C.; Peter F. Corless

(57) ABSTRACT

A workpiece locator is provided. The workpiece locator includes a base that is disposed on a work station and a locating member that is pivotally mounted on the base and has a holding structure that supports and fixes the position of at least one type of workpiece. Additionally, a locating member is configured to pivot to return to original positions.

12 Claims, 17 Drawing Sheets

WORKPIECE LOCATOR

CROSS-REFERENCE TO RELATED APPLICATION

This application is based on and claims the benefit of priority to Korean Patent Application No. 10-2017-0111942, filed on Sep. 1, 2017, the disclosure of which is incorporated herein in its entirety by reference.

BACKGROUND

1. Field of the Disclosure

The present disclosure relates to a workpiece locator, and more particularly, to a workpiece locator that locates a workpiece, such as a vehicle body, an engine, or the like, on a work station during a manufacturing process.

2. Description of the Related Art

Typically, a workpiece, including a vehicle body, an engine, or the like of a vehicle, is disposed and supported on a work station by a plurality of workpiece locators when components are assembled to the workpiece or when the assembled workpiece is inspected. Each workpiece locator positions and supports a portion of the workpiece to maintain the position of the workpiece on the work station. The plurality of workpiece locators are symmetrically disposed on front, rear, left, and right sides of the workpiece, and the workpiece is disposed and supported on the work station by the plurality of workpiece locators. Each workpiece locator has at least one locating member that supports a portion of the workpiece.

Generally, workpiece locators are categorized into a stationary workpiece locator and a variable workpiece locator. A stationary workpiece locator includes at least one locating member securely disposed at a predetermined position on a work station. The locating member includes a holding part that corresponds to one type of workpiece. Accordingly, the locating member may hold a specified workpiece that corresponds to the holding part. Furthermore, the stationary workpiece locator has a disadvantage that, when a different type of workpiece that does not correspond to the holding part of the locating member is loaded, the locating member and the workpiece interfere with each other. Accordingly, the design flexibility of the workpiece locator and the work station deteriorates. A variable workpiece locator includes at least one locating member movably disposed on a work station and appropriately holds different types of workpieces.

However, since the locating member is configured to work by energy, such as electrical energy, compressed air, or the like, the configuration of the variable workpiece locator may be complex. Additionally, the variable workpiece locator requires a significant amount of energy, (e.g., electrical energy, compressed air, or the like), which causes an increase in manufacturing cost and maintenance cost.

The above information disclosed in this section is merely for enhancement of understanding of the background of the disclosure and therefore it may contain information that does not form the prior art that is already known in this country to a person of ordinary skill in the art.

SUMMARY

The present disclosure provides a workpiece locator that may flexibly respond to various types of workpieces without consuming energy, such as electrical energy, fluid energy, or the like.

According to an aspect of the present disclosure, a workpiece locator may include a base disposed on a work station and a locating member pivotally mounted on the base and having a holding structure that holds at least one type of workpiece. In some exemplary embodiments, the locating member may be configured to pivot to return to an original position. The holding structure may have a support portion that corresponds to a portion of a type of workpiece.

In other exemplary embodiments, the workpiece locator may include an actuator configured to selectively pivot the locating member based on the types of loaded workpieces. The locating member may be configured to be pivoted by the actuator when a type of workpiece absent a portion that corresponds to a support portion of the holding structure is loaded on the pair of locating members. The locating member may be configured to move between a holding position and an evasion position by the actuator when different types of workpieces are selectively loaded above the locating member.

The holding position may correspond to a position in which the locating member holds a workpiece having a portion that corresponds to a support portion of the holding structure, and the evasion position may correspond to a position in which the locating members evades a workpiece absent a portion that corresponds to the support portion of the holding structure. The actuator may include at least one movable member and at least one stopper configured to move to fix the locating member by a movement of the at least one movable member. The movable member may be configured to move vertically. An upper surface of the movable member may be disposed at a higher position than upper ends of the locating member when the movable member is disposed at the highest position.

Additionally, the base may have a pair of mounting portion on which the locating member is separately pivotally mounted. The mounting portion may have a guide slot configured to guide the movement of the stopper. The locating member may have an insertion recess configured to receive the stopper selectively inserted therein. The stopper may be configured to move perpendicular to a moving direction of the movable member and may be selectively inserted into the insertion recess of the locating member.

In some exemplary embodiments, a cylinder may be connected to the movable member. A spring may be disposed around the cylinder, and the movable member may be elastically supported by the spring. The cylinder may have a stopper recess configured to receive the stopper selectively inserted therein. The cylinder may be configured to move between an insertion position and a release position based on the types of loaded workpieces. The insertion position may correspond to a position in which the stopper is inserted into the stopper recess of the cylinder, and the release position may correspond to a position in which the stopper is released from the stopper recess of the cylinder.

The locating member may have an insertion recess configured to receive the stopper selectively inserted therein. The stopper may be configured to move in the same direction as a moving direction of the movable member and may be selectively inserted into the insertion recess of the locating member. Additionally, the stopper may be integrally connected to the movable member through at least one guide extension. A spring may be mounted on the guide extension and the movable member may be elastically supported by the spring.

According to the present disclosure, the workpiece locator may flexibly respond to various types of workpieces without consuming energy, such as electrical energy, fluid energy, or the like. Additionally, since the pair of locating members may be configured to selectively pivot when different types of workpieces are selectively loaded, the workpiece locator may selectively hold or evade the different types of workpieces, to flexibly responds to the different types of workpieces.

BRIEF DESCRIPTION OF THE DRAWINGS

The above and other objects, features, and advantages of the present disclosure will be more apparent from the following detailed description taken in conjunction with the accompanying drawings.

DETAILED DESCRIPTION

Figure 1:
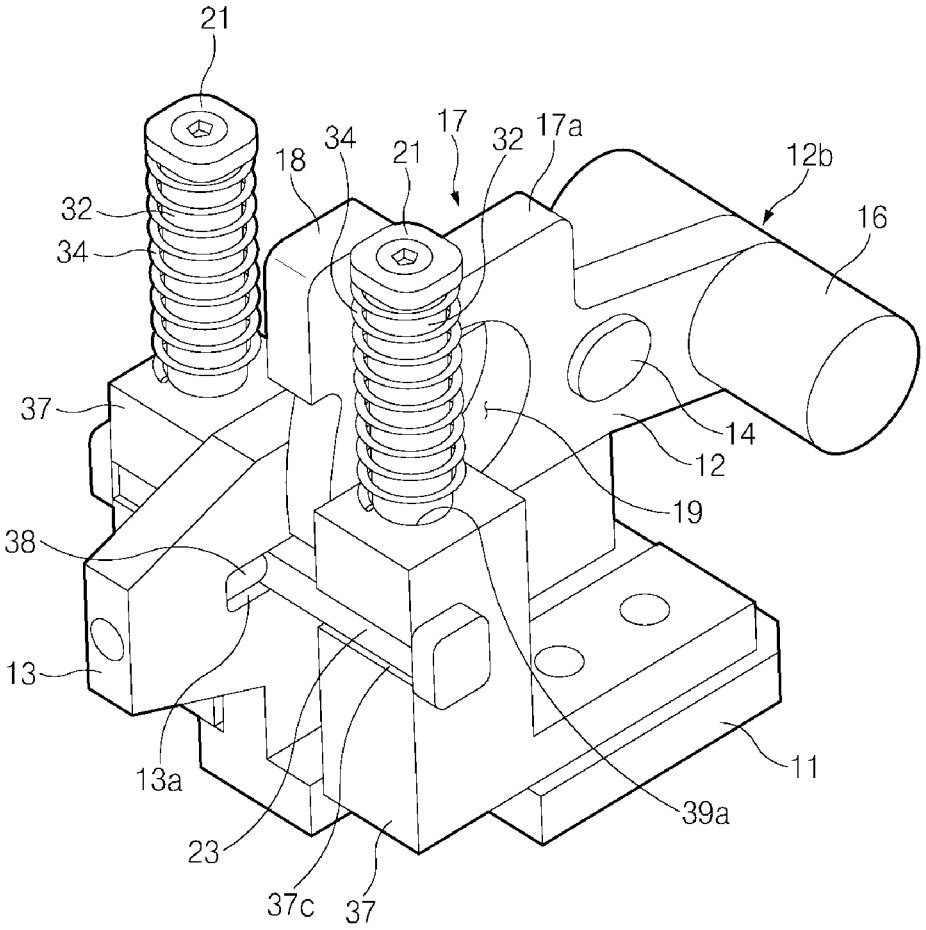
FIG. 1 is an exemplary perspective view of a workpiece locator according to an exemplary embodiment of the present disclosure.

Hereinafter, exemplary embodiments of the present disclosure will be described in detail with reference to the accompanying drawings. In the drawings, the same reference numbers will be used throughout to designate the same or equivalent elements. In addition, a detailed description of well-known features or functions will be ruled out in order not to unnecessarily obscure the gist of the present disclosure.

Terms, such as "first", "second", "A", "B", "(a)", "(b)", and the like, may be used herein to describe elements of the present disclosure. Such terms are only used to distinguish one element from another element, and the substance, sequence, order, or number of these elements is not limited by these terms. Unless otherwise defined, all terms used herein, including technical and scientific terms, have the same meaning as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, the term "and/or" includes any and all combinations of one or more of the associated listed items. For example, in order to make the description of the present disclosure clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

In accordance with an exemplary embodiment of the present disclosure, when at least one component is assembled to a workpiece 5, such as a vehicle body or an engine on a work station or when the assembled workpiece 5 is inspected on the work station the workpiece 5 may be disposed and supported by a plurality of workpiece locators 10 and thus may maintain a fixed position on the work station. The plurality of workpiece locators 10 may be symmetrically disposed on front, rear, left, and right sides of the workpiece 5 on the work station. Each workpiece locator 10 may fix a position of a portion of the workpiece 5. Accordingly, the workpiece 5 may maintain an entirely fixed position on the work station.

Referring to FIGS. 1 to 5, the workpiece locator 10 according to an exemplary embodiment of the present disclosure may include a base 11 and a locating member 12 pivotally mounted on the base 11. The base 11 may be mounted on the work station through fasteners and may have a mounting portion 13. The mounting portion 13 may be positioned upright in a vertical direction and may include a guide slot 13*a*. The locating member 12 may be pivotally mounted on the mounting portion 13. The locating member 12 may be pivotally mounted on the mounting portions 13 through pivot pins 14. The locating member 12 may include a holding structure 17 that maintains the position of a portion 5*a* of the workpiece 5, and the holding structure 17 may be formed on an upper portion of the locating member 12.

According to an exemplary embodiment of the present disclosure, the holding structure 17 may include a support portion 17*a* that corresponds to the portion 5*a* of the workpiece 5. The support portion 17*a* may position and support the portion 5*a* of the workpiece 5 (hereinafter, referred to as the "A-type workpiece"). In other words, the workpiece locator 10 according to an exemplary embodiment of the present disclosure may hold the A-type workpiece 5, which has the portion 5*a* that corresponds to the support portion 17*a* of the holding structure 17, and when a different type of workpiece 6 (hereinafter, referred to as the "B-type workpiece") other than the A-type workpiece 5 is loaded, locating member 12 may be configured to pivot to prevent interference with the B-type workpiece 6.

A vertical portion 18 may protrude vertically from a portion adjacent to the support portion 17*a*. The portion 5*a* of the A-type workpiece 5 may be securely supported by the support portion 17*a* and the vertical portion 18. Accordingly, the portion 5*a* of the A-type workpiece 5 may be more stably supported. The locating member 12 may include a first end portion 12*a* and a second end portion 12*b*. The first end portion 12*a* may include a stopper recess 15 formed thereon, and a counter weight 16 may be coupled to the second end portion 12*b*. The counter weight 16 may have a predetermined weight. The locating member 12 may have a cavity 19, and the weight and material of the locating member 12 may be reduced by the cavity 19. In consideration of the weight of the counter weight 16, the size and shape of the cavity 19 may allow the locating member 12 to be more stably maintained in a horizontal position.

An actuator 20 may be disposed between locating member 12 and configured to selectively pivot the locating member 12 based on the types of loaded workpieces 5 and 6. The locating member 12 may be configured to selectively pivot around the pivot pins 14 by the actuator 20. Since the locating member 12 is pivotally mounted on the mounting portions 13, the actuator 20 may be disposed adjacent to mounting portion 13. According to an exemplary embodiment, the actuator 20 may be configured to pivot locating member 12 when the B-type workpiece 6, which does not have a portion corresponding to the support portion 17*a* of the holding structure 17, is loaded toward locating member 12.

Accordingly, when the A-type workpiece 5 is loaded on the locating member 12, the locating member 12 may remain in a holding position (HP) to maintain the position of the A-type workpiece 5. See FIGS. 6 to 9. When the B-type workpiece 6 is loaded toward the locating member 12, the locating member 12 may be configured to pivot by the actuator 20 to move to an evasion position (EP) to evade the B-type workpiece 6 (see FIGS. 10 to 13).

As described above, the workpiece locator 10 according to an exemplary embodiment of the present disclosure may be configured to move the locating member 12 between the holding position (HP) and the evasion position (EP) by the actuator 20 when the different types of workpieces 5 and 6 are selectively loaded. For example, the holding position (HP) may refer to a position when the portion 5*a* of the A-type workpiece 5 is held on the holding structures 17 of locating member 12, and the evasion position (EP) may refer to a position when the locating member 12 evades the B-type workpiece 6.

Figure 2:
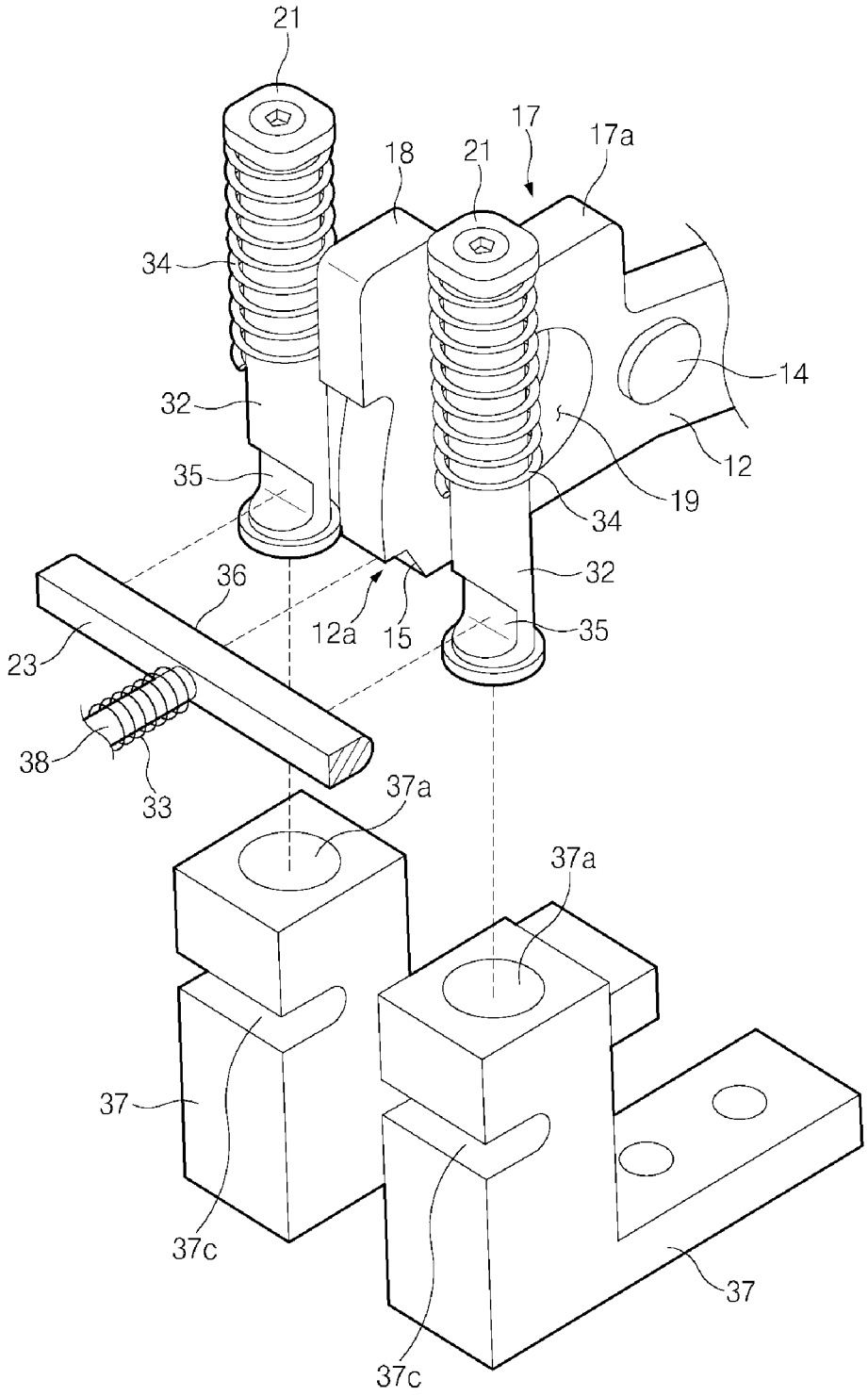
FIG. 2 is an exemplary detailed view of a part of an actuator in the workpiece locator, according to an exemplary embodiment of the present disclosure.

As illustrated in FIGS. 1 and 2, the actuator 20 according to an exemplary embodiment of the present disclosure may include a pair of movable members 21 configured to be vertically movable and a pair of stoppers 23 configured to restrict the position of the locating member 12 based on a movement of the pair of movable members 21. The pair of movable members 21 may be disposed symmetrically on both sides of mounting portion 13. According to an exemplary embodiment, movable members 21 may have an upper surface 21*a* configured to contact a portion 6*a* of the B-type workpiece 6.

According to an exemplary embodiment, when each movable members 21 is disposed at the highest position, the upper surface 21*a* of each movable member 21 may be disposed at a higher position than upper ends of the vertical portions 18 of the locating member 12. Accordingly, when the B-type workpiece 6 is loaded above locating member 12, the portion 6*a* of the B-type workpiece 6 may initially contact the upper surface 21*a* of the movable member 21, and thus the movable members 21 may be configured to move downwards by the load of the B-type workpiece 6. See FIGS. 10 to 12.

According to an exemplary embodiment of the present disclosure, the actuator 20 may further include a pair of cylinders 32 and each cylinder 32 may be connected to the each movable member 21. Each cylinder 32 may vertically extend from a bottom surface of each movable member 21 and may be configured to move vertically together with the corresponding movable member 21.

A spring 34 may be disposed around the each cylinder 32 and may be configured to apply an elastic force in the vertical direction. The spring 34 may be supported at an upper end thereof by each movable member 21 and may be supported at a lower end thereof by the base 11. Accordingly, the pair of movable members 21 and the pair of cylinders 32 may be configured to move vertically by the spring 34 to return to the original positions. Each cylinder 32 may have a stopper recess 35 into which the stopper 23 is selectively inserted. As the cylinder 32 moves in the vertical direction, the stopper 23 may be inserted into or released from the stopper recess 35 of the cylinder 32 and the stopper recess 15 of locating member 12. The stopper 23 may be configured to move perpendicular to the moving direction of the movable members 21 and the cylinders 32.

Figure 3:
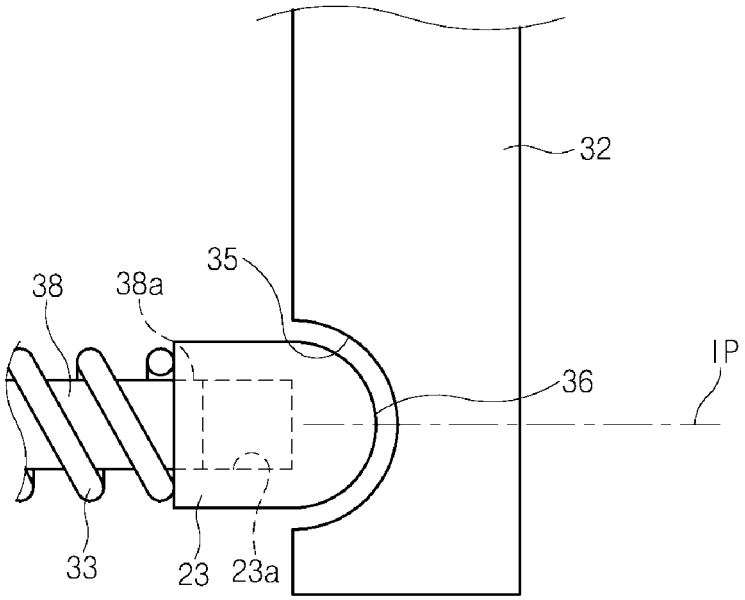
FIG. 3 illustrates an exemplary state in which insertion portions of a stopper of the actuator illustrated in FIG. 2 are inserted into stopper recesses of second cylinders according to an exemplary embodiment of the present disclosure.
Figure 4:
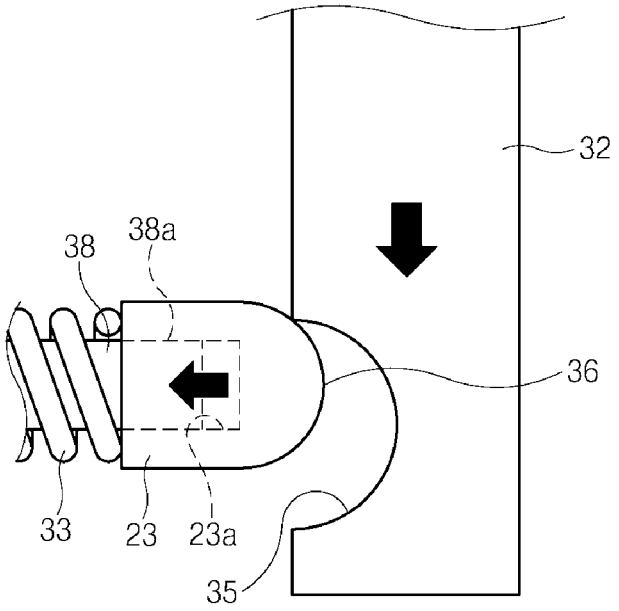
FIG. 4 illustrates an exemplary process in which the insertion portions of the stopper are released from the stopper recesses of the second cylinders as the second cylinders of the actuator of FIG. 2 move downwards according to an exemplary embodiment of the present disclosure.
Figure 5:
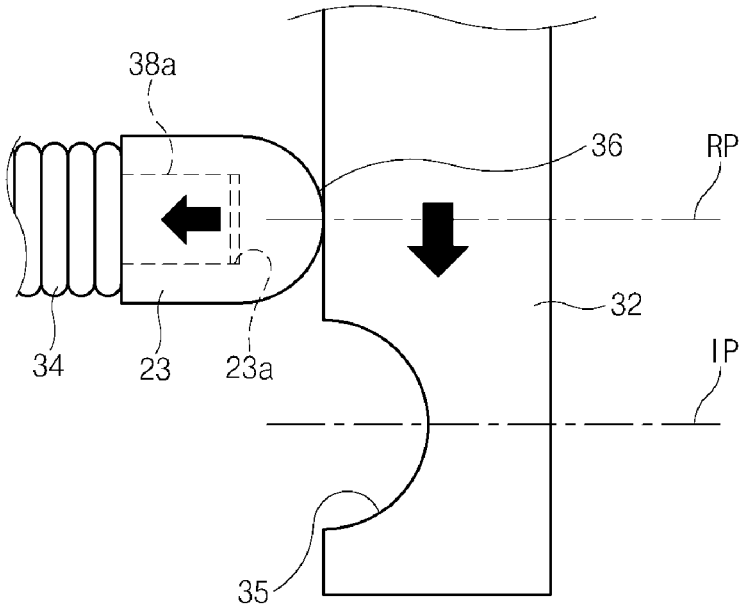
FIG. 5 illustrates an exemplary state in which the insertion portions of the stopper are completely released from the stopper recesses of the second cylinders when the second cylinders of the actuator of FIG. 2 completely move downwards according to an exemplary embodiment of the present disclosure.

According to an exemplary embodiment, as illustrated in FIGS. 3 to 5, the stopper 23 may be configured to move horizontally when the cylinder 32 moves vertically. The stopper 23 may have insertion portions 36, and the insertion portions 36 of the stopper 23 may have a shape that corresponds to the stopper recesses 35 of the cylinder 32 and the stopper recess 15 of the locating member 12.

Figure 12:
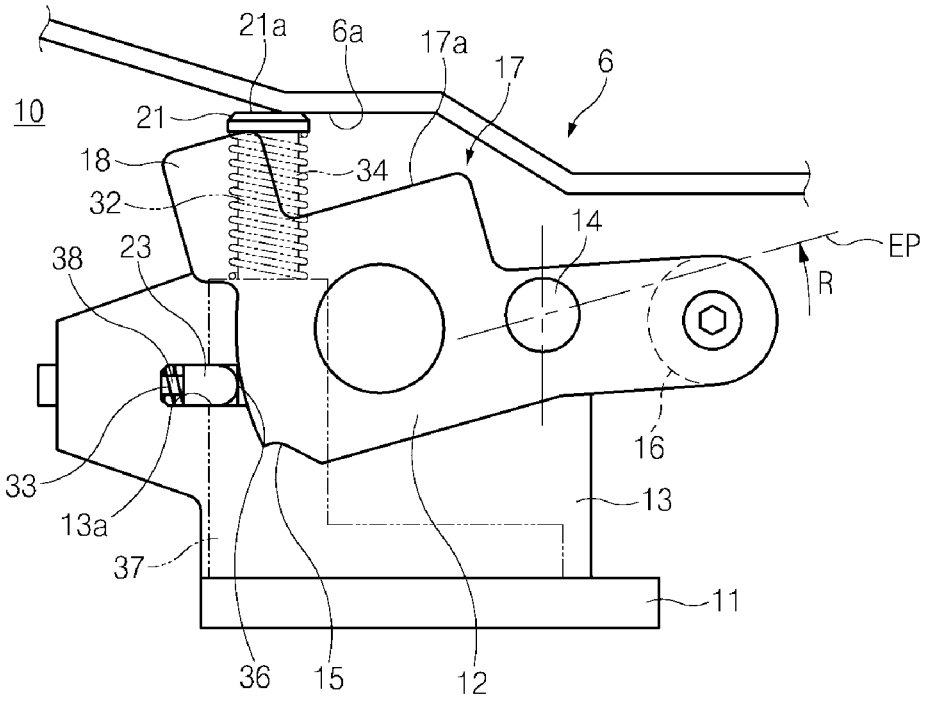

The movable members 21 and cylinders 32 may be configured to move between an insertion position (IP) (see FIGS. 3 and 5) and a release position (RP) (see FIG. 5) when the different types of workpieces 5 and 6 are selectively loaded on the workpiece locator 10. For example, the insertion position (IP) may refer to a position when no load is applied to the movable members 21 (e.g., when the A-type workpiece 5 is loaded or when the A-type workpiece 5 or the B-type workpiece 6 is unloaded), the spring 34 applies a force to the movable member 21 in an upward direction and thus, the insertion portions 36 of the stopper 23 are inserted into the stopper recesses 35 of cylinders 32 and the stopper recess 15 of the locating member 12, as illustrated in FIGS. 3 and 6 to 9. The release position (RP) may refer to a position when a load is applied to the movable member 21 (e.g., when the B-type workpiece 6 contacts the movable member 21), the spring 34 may be compressed in a downward direction by the load applied to the movable member 21 and the insertion portions 36 of the stopper 23 may be released from the stopper recesses 35 of cylinders 32 and the stopper recess 15 of the locating member 12, as illustrated in FIGS. 5 and 12.

When the insertion portions 36 of the stopper 23 are inserted into the stopper recess 15 of the locating member 12 and the stopper recesses 35 of cylinders 32 as illustrated in FIG. 3, the locating member 12 may remain in the holding position (HP). See FIG. 6. When the movable members 21 and cylinders 32 are moved toward the release position (RP) by the load applied to movable members 21 as illustrated in FIG. 4, the insertion portions 36 of the stopper 23 may be configured to move backwards while being released from the stopper recesses 35 of cylinders 32. Thereafter, when the insertion portions 36 of the stopper 23 are completely released from the stopper recess 15 of the locating member 12 and the stopper recesses 35 of cylinders 32 as illustrated in FIG. 5, the locating member 12 may be configured to pivot around the pivot pins 14 to move to the evasion position (EP). See FIG. 12.

The stopper 23 may be configured to separately guide along the guide slots 13*a* of the mounting portions 13. The guide slots 13*a* may extend in the horizontal direction and the stopper 23 may be configured to move horizontally along the guide slot 13*a* of the mounting portion 13. The movement of the stopper 23 may be guided by guide members 38. The stopper 23 may be elastically supported by a springs 33 to return to the original position. The guide members 38 may be mounted in the guide slot 13*a* of the mounting portion 13. The guide member 38 may extend along the guide slot 13*a* in the horizontal direction. The guide member 38 may be detachably mounted on the mounting portions 13 via a fastener.

The spring 33 may be configured to apply an elastic force to the stopper 23 in the horizontal direction to bias the stopper 23 toward the cylinders 32. The spring 33 may be disposed around the guide member 38 and may apply an elastic force to the stopper 23 in the horizontal direction. Accordingly, the stopper 23 may be elastically supported in the horizontal direction by the spring 33 within the guide slot 13*a*.

According to an exemplary embodiment, as illustrated in FIGS. 3 to 5, the stopper 23 may have a recess 23*a* formed on end portion thereof. An end 38*a* of the guide member 38 may be inserted into the recess 23*a* of the stopper 23. The guide member 38 may be securely disposed in the corresponding guide slot 13*a*. The actuator 20 may further include a pair of guide blocks 37 configured to guide a vertical movement of the pair of cylinders 32, respectively, and each guide block 37 may be disposed below each cylinder 32.

The guide block 37 may have a guide aperture 37*a* configured to guide each cylinder 32. The guide block 37 may have a guide groove 37*c* perpendicular to the guide aperture 37*a*, and the guide groove 37*c* may be formed in the horizontal direction. The guide groove 37*c* may be configured to guide a horizontal movement of the stopper 23. When the workpiece 5 or 6 does not make contact with the upper surface 21*a* of the movable member 21, the insertion portions 36 of the stopper 23 may be inserted into the stopper recesses 35 of cylinders 32, as illustrated in FIG. 3, and thus the vertical position of cylinders 32 may be maintained. When the portion 6*a* of the B-type workpiece 6 makes contact with the upper surface 21*a* of the movable member 21. See FIGS. 11 to 13. Each cylinder 32 may be configured to move downwards, as illustrated in FIGS. 4 and 5, and thus the insertion portions 36 of the stopper 23 may be released from the stopper recess 35 of each cylinders 32.

Figure 6:
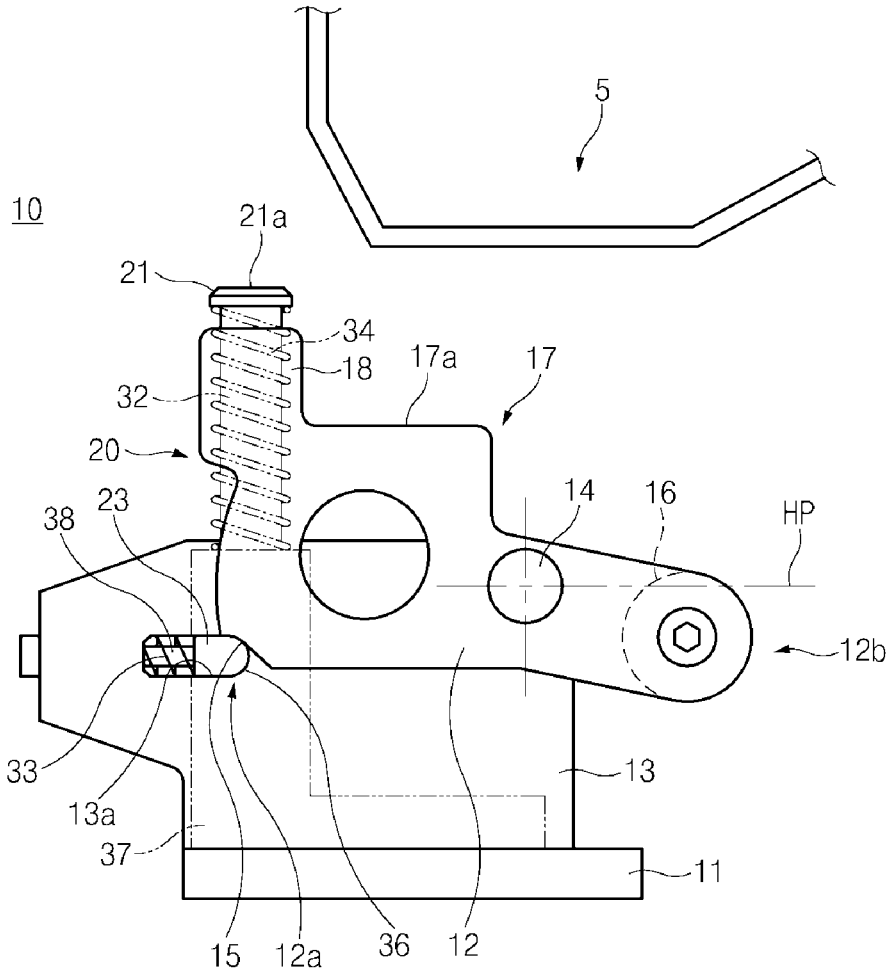
FIGS. 6 to 9 illustrate an exemplary process in which a portion of an A-type workpiece is fixed on the workpiece locator, according to an exemplary embodiment of the present disclosure.
Figure 7:
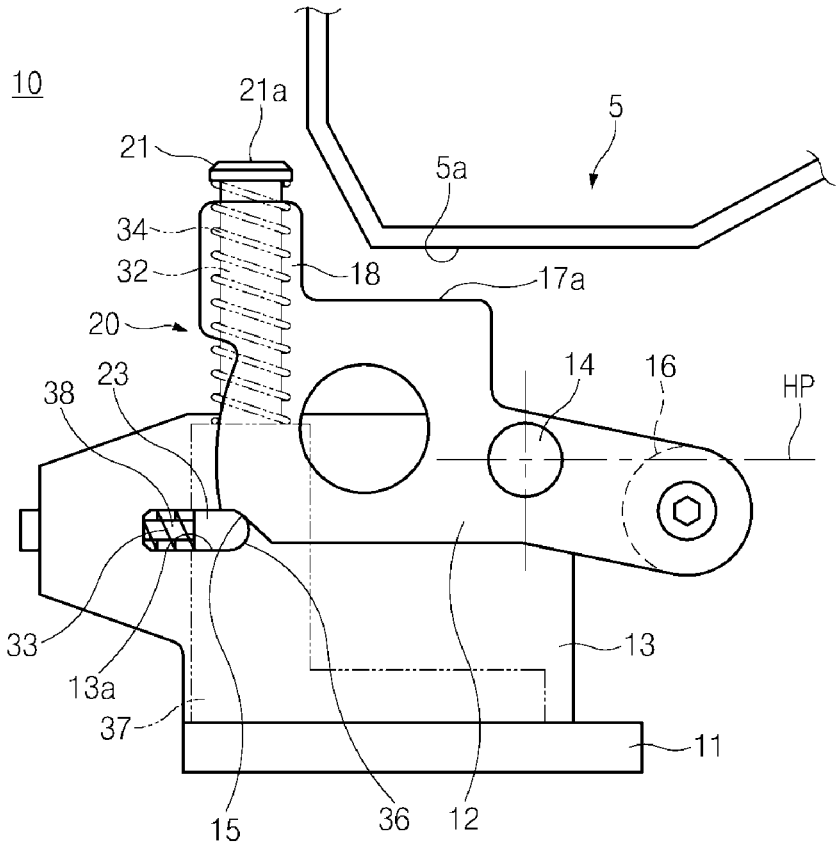
Figure 8:
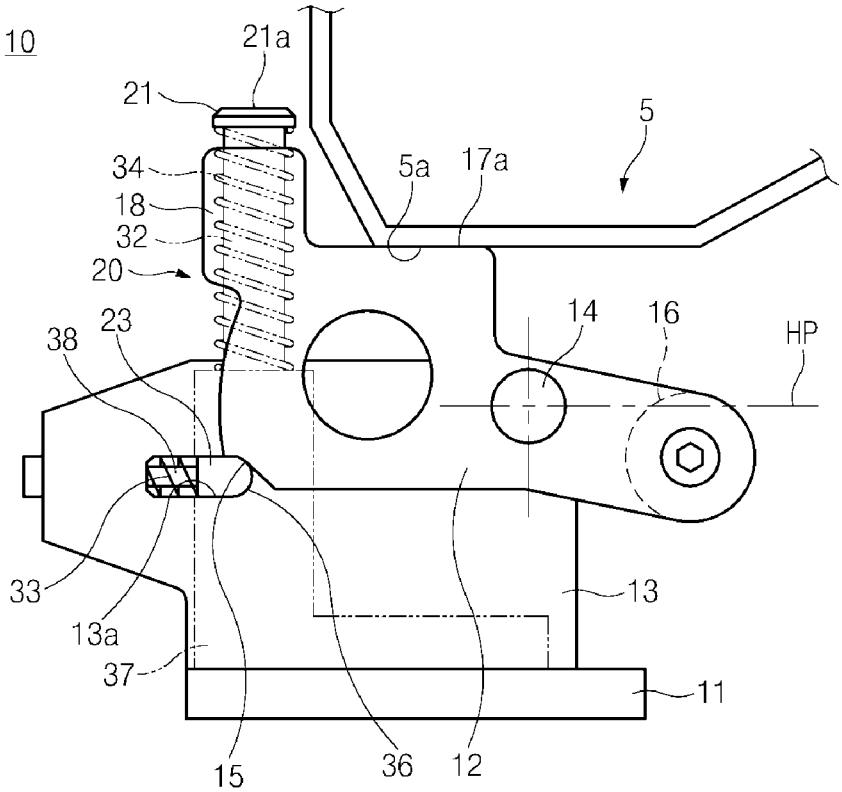

FIGS. 6 to 9 illustrate an exemplary process when the A-type workpiece 5 is held on the workpiece locator 10. When the A-type workpiece 5 is moved toward the workpiece locator 10 as illustrated in FIG. 6 and then loaded on the holding structures 17 of the locating member 12 of the workpiece locator 10 as illustrated in FIGS. 7 and 8, the portion 5*a* of the A-type workpiece 5 may be supported on the support portions 17*a* of the holding structures 17. Accordingly, the portion 5*a* of the A-type workpiece 5 may maintain a fixed position.

Since the A-type workpiece 5 does not make contact with the upper surface 21*a* of the movable member 21 of the actuator 20, the spring 34 disposed around cylinder 32 may be configured to apply a force to displace the movable member 21 upwards. Accordingly, the insertion portions 36 of the stopper 23 may be inserted into the stopper recesses 35 of cylinders 32. As a result, the vertical position of the movable members 21 and the pair of cylinders 32 may be maintained. At the same time, the insertion portions 36 of the stopper 23 may be inserted into the stopper recess 15 of the locating member 12, and the holding position (HP) of the locating member 12 may be maintained. See FIG. 6.

Figure 9:
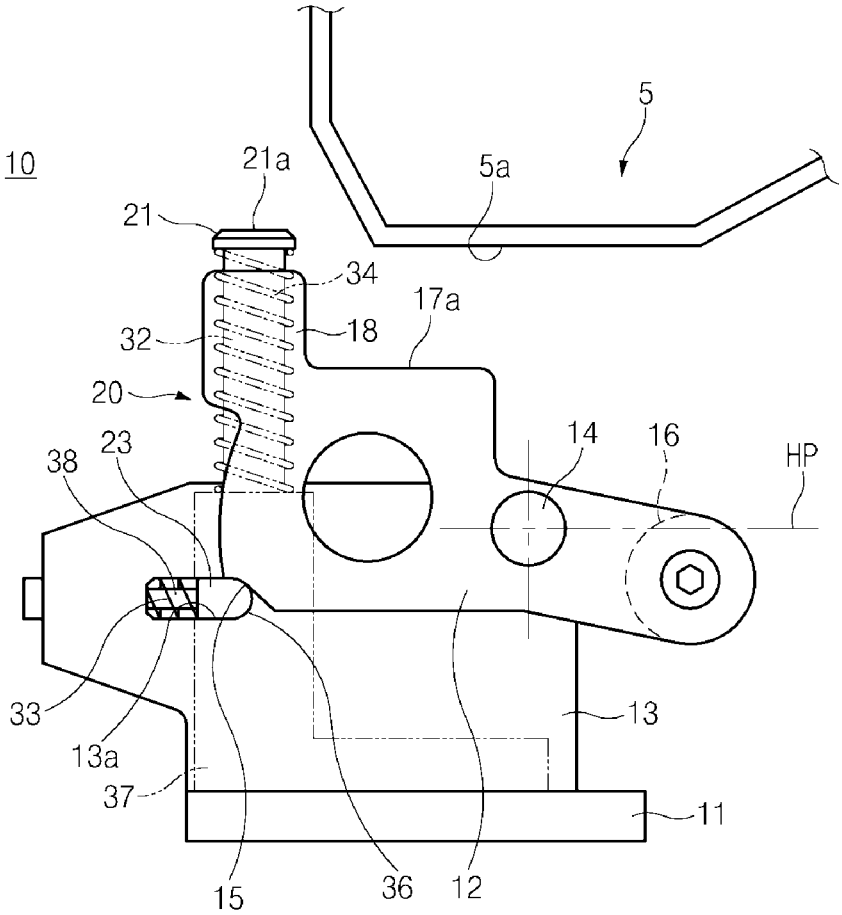

As described above, the portion 5*a* of the A-type workpiece 5 may maintain a fixed position on each workpiece locator 10, and the A-type workpiece 5 may be entirely fixed on the plurality of workpiece locators 10. When the A-type workpiece 5 position is fixed, an assembly or inspection process may be performed on the A-type workpiece 5. After the assembly or inspection process is completely performed on the A-type workpiece 5, the A-type workpiece 5 may be unloaded from the workpiece locator 10 as illustrated in FIG. 9.

Figure 10:
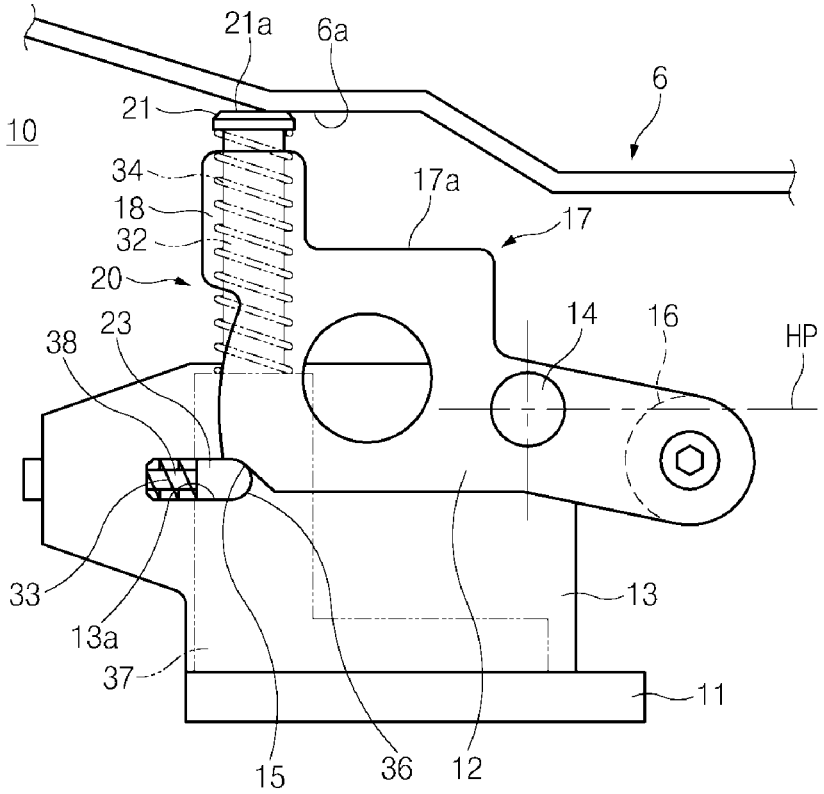
FIGS. 10 to 13 illustrate an exemplary process in which the workpiece locator evades a B-type workpiece, according to an exemplary embodiment of the present disclosure.
Figure 11:
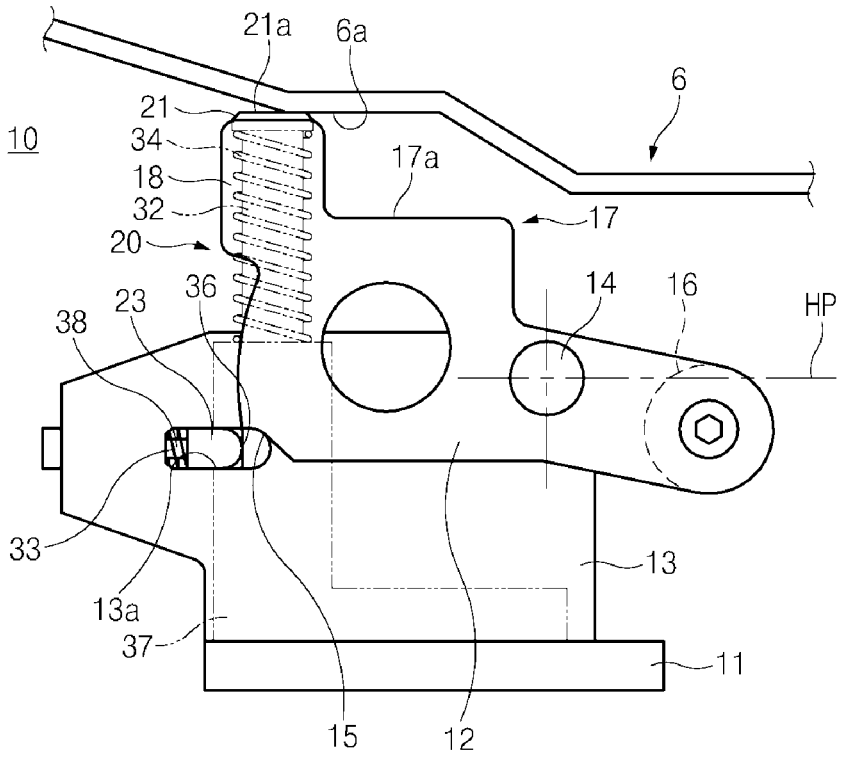

FIGS. 10 to 13 illustrate an exemplary process in which locating member 12 evades the B-type workpiece 6 when the B-type workpiece 6 is loaded on the workpiece locator 10. As illustrated in FIG. 10, the portion 6*a* of the B-type workpiece 6 may make contact with the upper surface of the movable member 21 when the B-type workpiece 6 is loaded on the workpiece locator 10. Then, as illustrated in FIG. 11, the movable member 21 may be moved downwards by the load of the B-type workpiece 6. When the movable member 21 is moved downwards, the insertion portions 36 of the stopper 23 may be released from the stopper recesses 35 of cylinders 32 and the stopper recess 15 of the locating member 12, as illustrated in FIGS. 4 and 5.

Since the insertion portions 36 of the stopper 23 are released from the stopper recess 15 of the locating member 12, the locating member 12 may be configured to pivot to the evasion position (EP) to prevent interference with the B-type workpiece 6, as illustrated in FIG. 12 (see the direction of arrow R in FIG. 12). In particular, the B-type workpiece 6 may maintain a fixed position on workpiece locators (not illustrated) that correspond to the B-type workpiece 6. When the B-type workpiece 6 is held in this way, an assembly or inspection process may be performed on the B-type workpiece 6.

Figure 13:
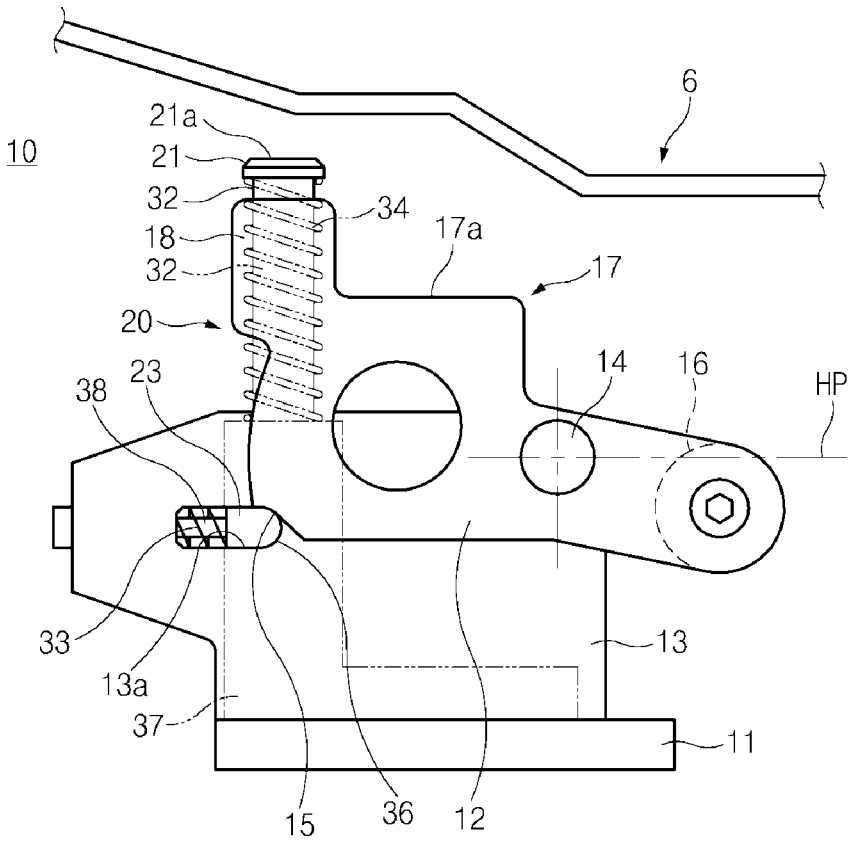

When the B-type workpiece 6 is unloaded from the workpiece locator 10, as illustrated in FIG. 13, after the assembly or inspection process is completely performed on the B-type workpiece 6, the locating member 12 may be configured to return to the original position (e.g., the holding position (HP)) by the load of the counter weight 16 and the elastic force of the spring 34. Since the actuator 20 is disposed on the opposite side to the counter weight 16, locating member 12 may return more easily from the evasion position (EP) to the holding position (HP) by the load of the counter weight 16 and the elastic force of the spring 34.

Meanwhile, according to an exemplary embodiment of the present disclosure, the holding structure 17 of each locating member 12 may have a second support portion (not illustrated) that supports a portion of the B-type workpiece 6 when the locating member 12 has moved to the evasion position (EP). Accordingly, the workpiece locator 10 according to the exemplary embodiment of the present disclosure may separately hold the different types of workpieces 5 and 6.

Figure 14:
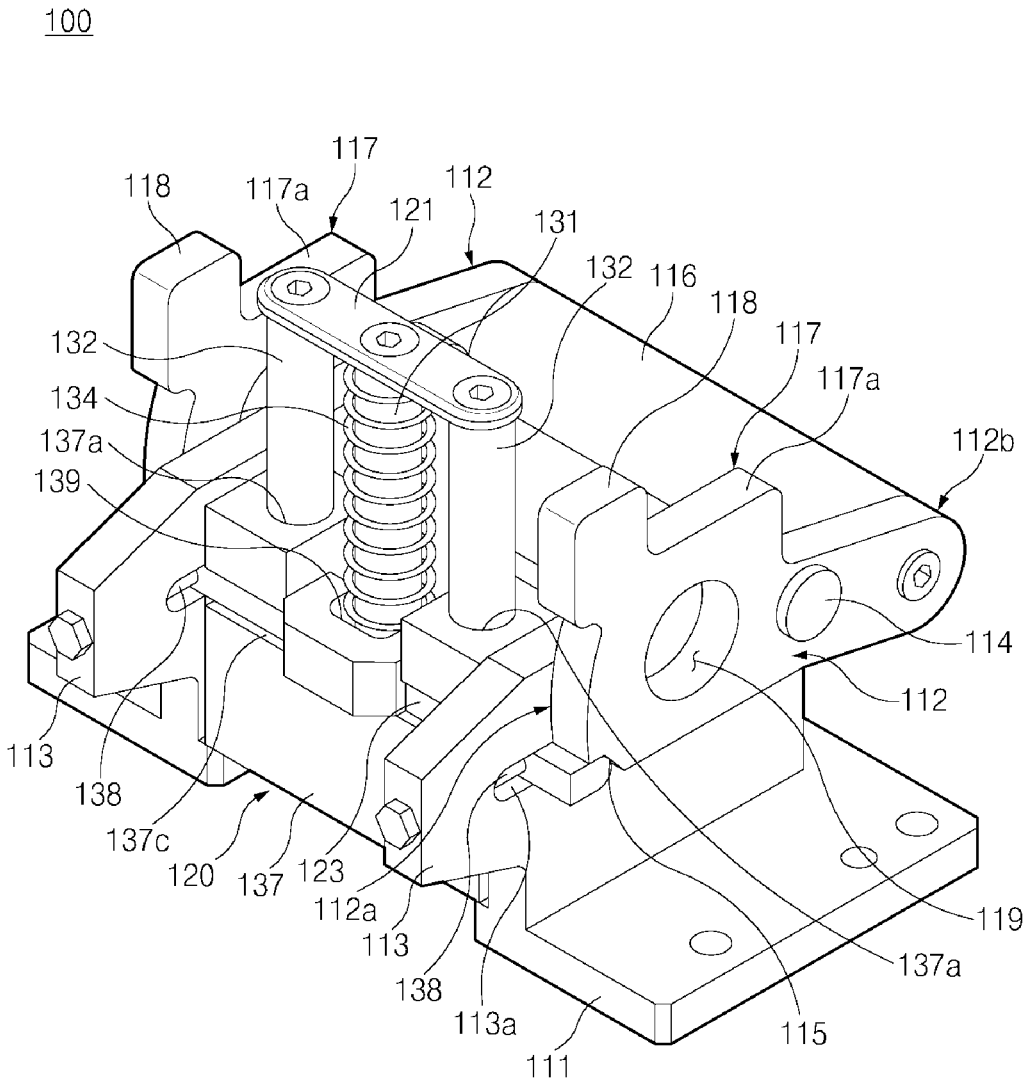
FIG. 14 is an exemplary perspective view of a workpiece locator according to another exemplary embodiment of the present disclosure.
Figure 15:
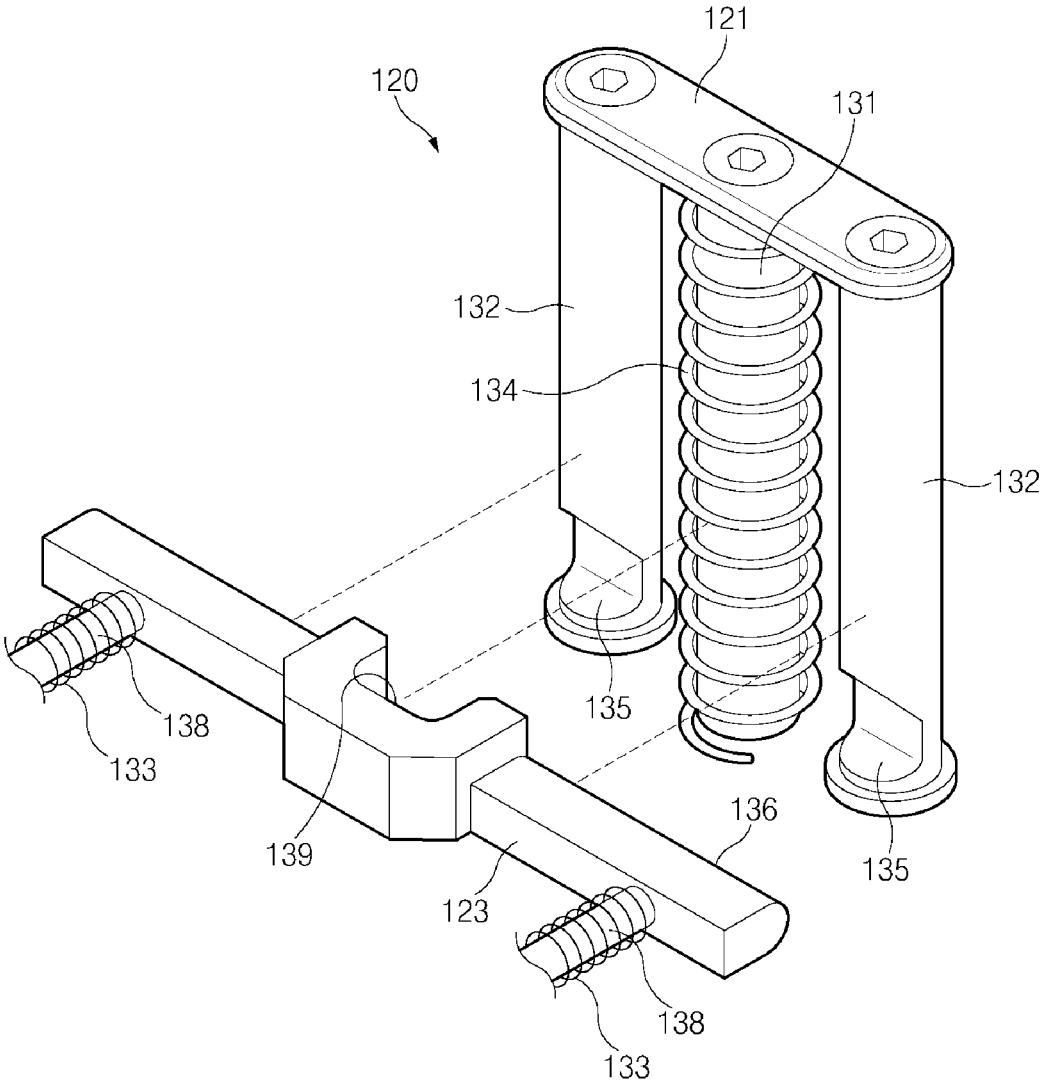
FIG. 15 is an exemplary exploded perspective view of a portion of an actuator in the workpiece locator, according to another exemplary embodiment of the present disclosure.

Referring to FIGS. 14 and 15, the workpiece locator 100 according to another exemplary embodiment of the present disclosure may include a base 111 and a pair of locating members 112 pivotally mounted on the base 111. The base 111 may be mounted on the work station through fasteners and may have a pair of mounting portions 113 spaced apart from each other. Each mounting portion 113 may be disposed in a vertically upright position and may have a guide slot 113*a*.

The pair of locating members 112 may be separately pivotally mounted on the pair of mounting portions 113 and may be spaced apart from each other by the distance between the mounting portions 113. The locating members 112 may be pivotally mounted on the mounting portions 113 through pivot pins 114, respectively. Each locating member 112 may have a holding structure 117 that holds a portion 5*a* of the workpiece 5, and the holding structure 117 may be formed on an upper portion of the locating member 112.

According to an exemplary embodiment of the present disclosure, the holding structure 117 may have a support portion 117*a* that corresponds to the portion 5*a* of the workpiece 5. The support portion 117*a* may be configured to locate and support the portion 5*a* of the A-type workpiece 5. In other words, the workpiece locator 100 according to an exemplary embodiment of the present disclosure may hold the A-type workpiece 5, which has the portion 5*a* corresponding to the support portion 117*a* of the holding structure 117. When the case where the B-type of workpiece 6 is loaded the pair of locating members 112 may be configured to pivot to prevent interference with the B-type workpiece 6. A vertical portion 118 may protrude vertically from a portion adjacent to the support portion 117*a*. The portion 5*a* of the A-type workpiece 5 may be more securely supported by the support portion 117*a* and the vertical portion 118. Accordingly, the portion 5*a* of the A-type workpiece 5 may be held more stably.

The pair of locating members 112 may be connected together by a counter weight 116, and the counter weight 116 may have a predetermined weight. Each locating member 112 may have a first end portion 112*a* and a second end portion 12*b*. The first end portion 112*a* may have a stopper recess 115 formed thereon, and an end portion of the counter weight 116 may be coupled to the second end portion 112*b*. The counter weight 116 may connect the second end portions 112*b* of the locating members 112. Each locating member 112 may have a cavity 119, and the weight and material of the locating member 112 may be reduced by the cavity 119. In consideration of the weight of the counter weight 116, the size and shape of the cavity 119 may be designed to allow the locating member 112 to be more stably maintained in a horizontal position.

An actuator 120 may be disposed between the pair of locating members 112 to selectively pivot the pair of the locating members 112 according to the types of loaded workpieces 5 and 6. The pair of locating members 112 may be configured to selectively pivot around the pivot pins 114 by the actuator 120. Since the locating members 112 are pivotally mounted on the mounting portions 113, respectively, the actuator 120 may be disposed between the pair of mounting portions 113. According to an exemplary embodiment, the actuator 120 may be configured to pivot the pair of locating members 112 when the B-type workpiece 6, which does not have a portion corresponding to the support portion 117*a* of the holding structure 117, is loaded toward the pair of locating members 112.

As described above, the workpiece locator 100 according to an exemplary embodiment of the present disclosure may be configured to move the pair of locating members 112 between the holding position (HP) and the evasion position (EP) by the actuator 120 when the different types of workpieces 5 and 6 are selectively loaded. For example, the holding position (HP) may refer to a position in which the portion 5*a* of the A-type workpiece 5 is held on the holding structures 117 of the pair of locating members 112, and the evasion position (EP) may refer to a position in which the pair of locating members 112 evades the B-type workpiece 6.

As illustrated in FIGS. 14 and 15, the actuator 120 according to an exemplary embodiment of the present disclosure may include a movable member 121 configured to be vertically movable and a stopper 123 configured to restrict the position of the pair of locating members 112 based on a movement of the movable member 121. The movable member 121 may be disposed between the pair of mounting portions 113. Accordingly, the movable member 121 may be disposed between the pair of locating members 112. The movable member 121 may be configured to move vertically. The movable member 121 may have an upper surface 121*a* with which a portion 6*a* of the B-type workpiece 6 makes contact.

When the movable member 121 is disposed at the highest position, the upper surface 121*a* of the movable member 121 may be disposed at a higher position than upper ends of the vertical portions 118 of the locating members 112. Accordingly, when the B-type workpiece 6 is loaded above the pair of locating members 112, the portion 6*a* of the B-type workpiece 6 may first make contact with the upper surface 121*a* of the movable member 121, and thus the movable member 121 may be configured to move downwards by the load of the B-type workpiece 6.

As illustrated in FIG. 15, the actuator 120 may further include a plurality of cylinders 131 and 132 integrally connected to the movable member 121. The plurality of cylinders 131 and 132 may vertically extend from a bottom surface of the movable member 121 and may be configured to move vertically together with the movable member 121. The plurality of cylinders 131 and 132 may include the first cylinder 131 and the pair of second cylinders 132 disposed on both left and right sides of the first cylinder 131. The first cylinder 131 and the pair of second cylinders 132 may have the same length. A spring 134 may be mounted on the first cylinder 131 and may be configured to apply an elastic force in the vertical direction. The spring 134 may be supported, at an upper end thereof, by the movable member 121 and may be supported, at a lower end thereof, by the base 111. Accordingly, the movable member 121 and the first and second cylinders 131 and 132 may be configured to move vertically by the spring 134 to return to the original positions. The spring 134, when stretched, may have a greater length than the first cylinder 131.

Each second cylinder 132 may have a stopper recess 135 into which the stopper 123 is selectively inserted. As the second cylinder 132 moves in the vertical direction, the stopper 123 may be inserted into or released from the stopper recess 135 of the second cylinder 132 and the stopper recess of each locating members 112. The stopper 123 between the pair of locating members 112 may be configured to move in a direction perpendicular to the moving direction of the movable member 121 and the cylinders 131 and 132. The stopper 123 may be configured to move horizontally when the first and second cylinders 131 and 132 move vertically.

As illustrated in FIG. 15, the stopper 123 may have insertion portions 136. The insertion portions 136 of the stopper 123 may have a shape that corresponds to the stopper recesses 135 of the second cylinders 132 and the stopper recesses 115 of the locating members 112. Opposite end portions of the stopper 123 may be guided along the guide slots 113*a* of the mounting portions 113, respectively. The guide slots 113*a* may extend horizontally and the stopper 123 may be configured to move horizontally along the guide slots 113*a* of the mounting portions 113. The movement of the stopper 123 may be guided by a pair of guide members 138, and the stopper 123 may be elastically supported by a pair of springs 133 to return to the original position.

The pair of guide members 138 may be separately mounted in the guide slots 113*a* of the mounting portions 113. The guide members 138 may extend along the guide slots 113*a* horizontally. The guide members 138 may be selectively mounted on the mounting portions 113 through fasteners. The pair of springs 133 may be configured to apply an elastic force to the stopper 123 in the horizontal direction to bias the stopper 123 toward the second cylinders 132. The springs 133 may be mounted on the respective guide members 138 and may be configured to horizontally apply an elastic force to the stopper 123. Accordingly, the stopper 123 may be elastically supported in the horizontal direction by the springs 133 within the guide slots 113*a*.

As illustrated in FIG. 14, the pair of guide members 138 may be disposed on the opposite end portions of the stopper 123. The stopper 123 may have a groove 139 through which the first cylinder 131 passes. Accordingly, the stopper 123 and the first cylinder 131 may not interfere with each other.

The actuator 120 may further include a guide block 137 configured to guide a vertical movement of the pair of second cylinders 132. The guide block 137 may be disposed below the plurality of cylinders 131 and 132. The guide block 137 may have a pair of guide apertures 137*a* configured to guide the pair of second cylinders 132, respectively. The guide block 137 may have a guide groove 137*c* perpendicular to the pair of guide apertures 137*a*, and the guide groove 137*c* may be formed in the horizontal direction. The guide groove 137*c* may be configured to guide a horizontal movement of the stopper 123.

When the workpiece 5 or 6 does not make contact with the upper surface 121*a* of the movable member 121, the insertion portions 136 of the stopper 123 may be inserted into the stopper recesses 135 of the second cylinders 132, as illustrated in FIG. 3. Accordingly, the vertical position of the second cylinders 132 may be maintained. When the portion 6*a* of the B-type workpiece 6 contacts the upper surface 121*a* of the movable member 121, the second cylinders 132 may be configured to move downwards, and thus the insertion portions 136 of the stopper 123 may be released from the stopper recesses 135 of the second cylinders 132. Since the other elements and operations thereof are similar to, or the same as, those in the exemplary embodiment illustrated in FIGS. 1 to 13, detailed descriptions thereof will be omitted.

Figure 16:
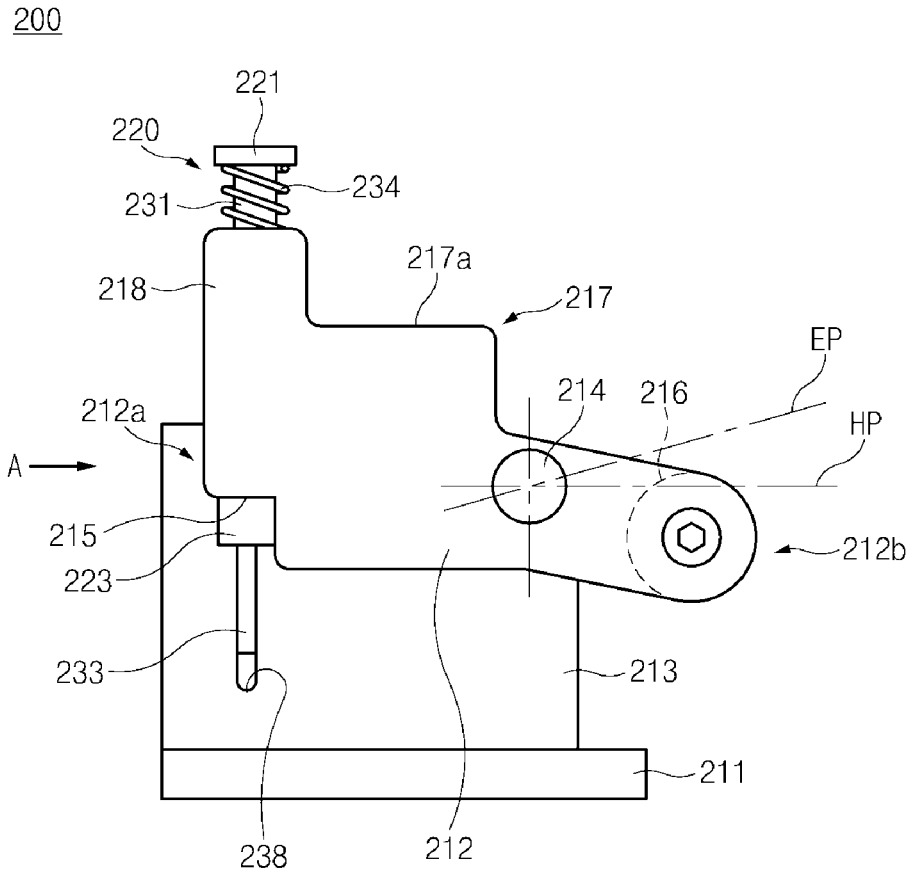
FIG. 16 is an exemplary side view of a workpiece locator according to another exemplary embodiment of the present disclosure.
Figure 17:
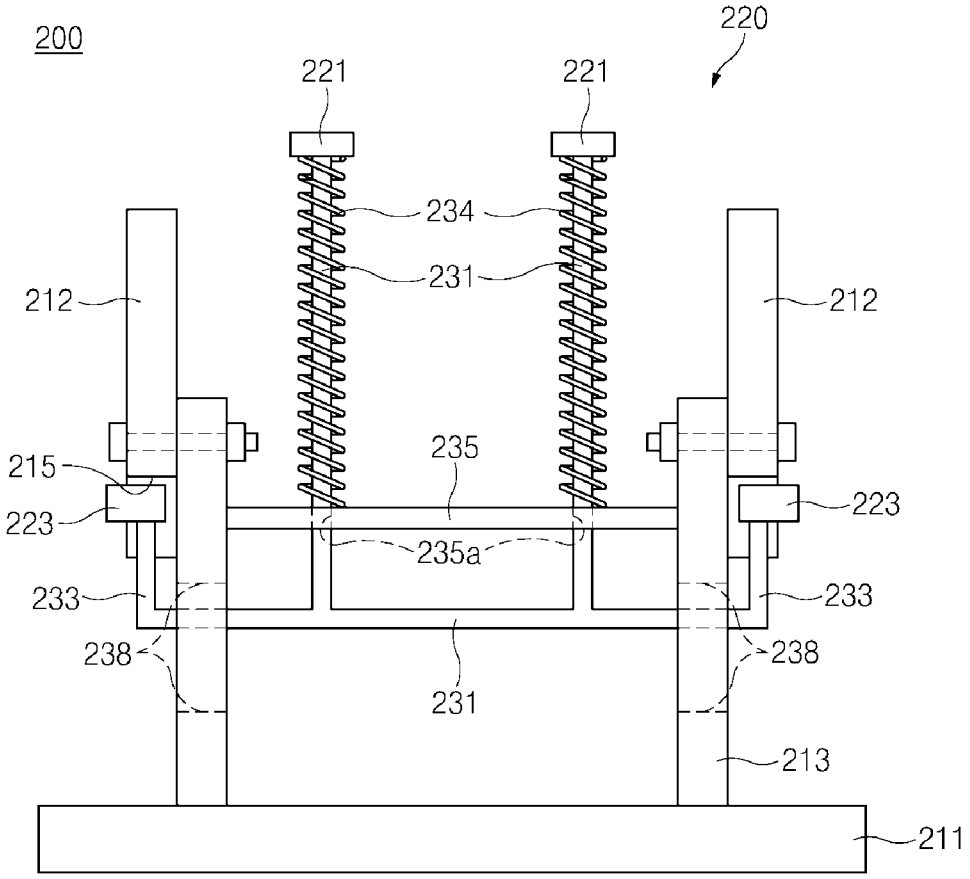
FIG. 17 is an exemplary view of the workpiece locator, when viewed in the direction of arrow A in FIG. 14 according to an exemplary embodiment of the present disclosure.

Referring to FIGS. 16 and 17, the workpiece locator 200 according to an exemplary embodiment of the present disclosure may include a base 211 and a pair of locating members 212 pivotally mounted on the base 211. The base 211 may be mounted on the work station through fasteners and may have a pair of mounting portions 213 spaced apart from each other. Each mounting portion 213 may be disposed upright in a vertical direction and may have a guide slot 213*a*.

The pair of locating members 212 may be separately pivotally mounted on the pair of mounting portions 213 and may be spaced apart from each other by the distance between the mounting portions 213. The locating members 212 may be pivotally mounted on the mounting portions 213 through pivot pins 214, respectively. Each locating member 212 may have a holding structure 217 configured to maintain a position of a portion 5*a* of the workpiece 5, and the holding structure 217 may be formed on an upper portion of the locating member 212. The holding structure 217 may have a support portion 217*a* that corresponds to the portion 5*a* of the workpiece 5. The support portion 217*a* may locate and support the portion 5*a* of the A-type workpiece 5.

In other words, the workpiece locator 200 according to an exemplary embodiment of the present disclosure may support the A-type workpiece 5, which has the portion 5*a* corresponding to the support portion 217*a* of the holding structure 217. When the B-type of workpiece 6 is loaded, the pair of locating members 212 may be configured to pivot to prevent interference with the B-type workpiece 6.

A vertical portion 218 may vertically protrude from a portion adjacent to the support portion 217*a*. The portion 5*a* of the A-type workpiece 5 may be securely supported by the support portion 217*a* and the vertical portion 218. Accordingly, the portion 5*a* of the A-type workpiece 5 may be more stably maintained. The pair of locating members 212 may be connected together by a counter weight 216. The counter weight 216 may have a predetermined weight. Each locating member 212 may have a first end portion 212*a* and a second end portion 212*b*. The first end portion 212*a* may have a stopper recess 215 formed thereon, and an end portion of the counter weight 216 may be coupled to the second end portion 212*b*. The counter weight 216 may be configured to connect the second end portions 212*b* of the locating members 212.

An actuator 220 may be disposed between the pair of locating members 212 to selectively pivot the pair of the locating members 212 based on the types of loaded workpieces 5 and 6. The pair of locating members 212 may be selectively pivoted around the pivot pins 214 by the actuator 120. Since the locating members 212 are pivotally mounted on the mounting portions 213, respectively, the actuator 220 may be disposed between the pair of mounting portions 213. The actuator 220 may be configured to pivot the pair of locating members 212 when the B-type workpiece 6, which does not have a portion corresponding to the support portion 217*a* of the holding structure 217, is loaded toward the pair of locating members 212.

As described above, the workpiece locator 200 according to an exemplary embodiment of the present disclosure may be configured to move the pair of locating members 212 between the holding position (HP) and the evasion position (EP) by the actuator 220 when the different types of workpieces 5 and 6 are selectively loaded. For example, the holding position (HP) may refer to a position in which the portion 5*a* of the A-type workpiece 5 may maintain a fixed position on the holding structures 217 of the pair of locating members 212, and the evasion position (EP) may refer to a position in which the pair of locating members 212 evades the B-type workpiece 6.

An actuator 220 according to the exemplary embodiment of FIGS. 16 and 17 may include a pair of movable members 221 movable in a vertical direction and a pair of stoppers 223 configured to restrict the positions of locating members 212 according to a movement of the pair of movable members 221. The pair of movable members 221 may be disposed between the pair of mounting portions 213 and may be spaced apart from each other. Accordingly, the pair of movable members 221 may be disposed between locating members 212. The pair of movable members 121 may be configured to move vertically. A pair of guide extensions 231 may be separately connected to the pair of movable members 221, and the guide extensions 231 may extend vertically. The pair of guide extensions 231 may be integrally connected to a connecting portion 232, and the connecting portion 232 may extend horizontally.

A guide support 235 may be disposed above the connecting portion 232 and may extend horizontally through the pair of mounting portions 213. The guide support 135 may have opposite ends secured to the respective mounting portions 213. The guide support 235 may have a pair of guide apertures 235*a* through which the pair of guide extensions 231 separately passes.

The pair of movable members 221 may be separately elastically supported by a pair of springs 234. The springs 234 may be disposed on an exterior surface of the guide support 235 in the vertical direction. Each spring 234 may be supported, at an upper end thereof, by the corresponding movable member 221 and may be supported, at a lower end thereof, by the guide support 235. Accordingly, the pair of movable members 221, the pair of guide extensions 231, and the connecting portion 232 may be configured to move vertically by the pair of springs 234 to return to the original positions.

A pair of stoppers 223 may be separately connected to opposite end portions of the connecting portion 232. The connecting portion 232 may have a pair of vertical portions 233 separately formed on the opposite end portions thereof, and the vertical portions 233 may extend vertically. The stoppers 223 may be integrally connected to the opposite end portions of the connecting portion 232 through the vertical portions 233. Each mounting portion 213 may have a guide slot 238 that extends vertically. The opposite end portions of the connecting portion 232 may be configured to vertically move along the guide slots 238 of the mounting portions 213. The pair of stoppers 223 may be configured to move vertically by the vertical movement of the connecting portion 232. When the pair of movable members 221 vertically moves in this way, the pair of guide extensions 231, the pair of springs 234, and the connecting portion 232 may be configured to move vertically together. Accordingly, the pair of stoppers 223 may be configured to move vertically and may be released from or inserted into the stopper recesses 215 of the locating member 212 by the vertical movement thereof.

As described above, the actuator 220 according to the exemplary embodiment of FIGS. 16 and 17 may be configured to include the pair of movable members 221 and the pair of stoppers 223 configured to move in the same direction. In other words, when the pair of movable members 221 moves in the vertical direction, the pair of stoppers 223 may be configured to move in the vertical direction since the pair of stoppers 223 is integrally connected to the pair of movable members 221 by the pair of guide extensions 231, the connecting portion 223, and the pair of vertical portions 233. Since the other elements and operations thereof are similar to, or the same as, those in the exemplary embodiment illustrated in FIGS. 1 to 15, detailed descriptions thereof will be omitted.

Although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure.

What is claimed is:

1. A workpiece locator, comprising:

a base disposed on a work station;

a locating member pivotally mounted on the base and having a holding structure configured to fix a position of at least one type of workpiece; and an actuator configured to selectively pivot the locating member based on the type of loaded workpiece;

wherein the actuator includes:

at least one movable movable member; and a stopper configured to move to fix a position of the locating member by a movement of the at least one movable member;

wherein the locating member has an insertion recess into which the stopper is selectively inserted, and the stopper is configured to move in a direction perpendicular to a moving direction of the movable member and is configured to be selectively inserted into the insertion recess of the locating member.

2. The workpiece locator of claim 1, wherein the holding structure has a support portion that corresponds to a portion of the type of workpiece.

3. The workpiece locator of claim 1, wherein the locating member is configured to be pivoted by the actuator when a type of workpiece absent a portion that corresponds to a support portion of the holding structure is loaded above the locating member.

4. The workpiece locator of claim 1, wherein the locating member is configured to move between a holding position and an evasion position by the actuator when different types of workpieces are selectively loaded above the locating member, and wherein the holding position corresponds to a position in which the locating member fixes a position of a workpiece having a portion that corresponds to a support portion of the holding structure, and the evasion position corresponds to a position in which the locating member evades a workpiece absent the portion that corresponds to the support portion of the holding structure.

5. The workpiece locator of claim 1, wherein the movable member is configured to move vertically.

6. The workpiece locator of claim 1, wherein an upper surface of the movable member is disposed at a higher position than upper ends of the locating member when the movable member is disposed at the highest position.

7. The workpiece locator of claim 1, wherein the base has a mounting portion on which the locating member is pivotally mounted, and the mounting portion has a guide slot configured to guide the movement of the stopper.

8. The workpiece locator of claim 1, wherein a cylinder is connected to the movable member, wherein a spring is disposed around the cylinder, the movable member is elastically supported by the spring, and the cylinder has a stopper recess configured to receive the stopper selectively inserted therein.

9. The workpiece locator of claim 8, wherein the cylinder is configured to move between an insertion position and a release position based on the type of loaded workpiece, and the insertion position corresponds to a position in which the stopper is inserted into the stopper recess of the cylinder, and the release position corresponds to a position in which the stopper is released from the stopper recess of the cylinder.

10. The workpiece locator of claim 1, wherein the locating member has an insertion recess into which the stopper is selectively inserted, and the stopper is configured to move in the same direction as the movable member and is selectively inserted into the insertion recess of the locating member.

11. The workpiece locator of claim 10, wherein the stopper is integrally connected to the movable member through at least one guide extension.

12. The workpiece locator of claim 11, wherein a spring is disposed around the guide extension, and the movable member is elastically supported by the spring.

* * * * *